US006103961A

United States Patent [19]

Kaufman

[11] Patent Number: 6,103,961

[45] Date of Patent: Aug. 15, 2000

[54] STRINGED MUSICAL INSTRUMENT

[76] Inventor: William Kaufman, 2449 Soto St. #213, San Diego, Calif. 92107

[21] Appl. No.: 09/226,559

[22] Filed: Jan. 7, 1999

[51] Int. Cl.[7] ..... G10D 3/00

[52] U.S. Cl. ..... 84/291; 84/292; 84/293; 84/294

[58] Field of Search ..... 84/267, 268, 269, 84/274, 275, 276, 277, 278, 279, 280, 281, 282, 283, 290, 291, 292, 293, 294, 298, DIG. 24

[56] References Cited

U.S. PATENT DOCUMENTS

| | | | |
|---|---|---|---|
| 10,867 | 5/1854 | Short | 84/291 |
| D. 315,744 | 3/1991 | Lerch | D17/14 |
| 549,966 | 11/1895 | Hutchins | 84/268 |
| 586,032 | 7/1897 | Hartman | 84/267 |
| 590,026 | 9/1897 | Swalley | 84/293 |
| 598,245 | 2/1898 | Gibson | 84/268 |
| 636,692 | 11/1899 | Patch | 84/290 |
| 647,173 | 4/1900 | Almcrantz | 84/267 |
| 976,428 | 11/1910 | Benson et al. | 84/298 |
| 1,180,991 | 4/1916 | Ernst | 84/267 |
| 2,597,154 | 5/1952 | Maccaferri | 84/267 |
| 2,953,052 | 9/1960 | Newton | 84/1.16 |
| 3,072,007 | 1/1963 | Burke | 84/267 |
| 3,869,954 | 3/1975 | Ito | 84/291 |
| 4,189,974 | 2/1980 | Martin et al. | 84/293 |
| 4,317,402 | 3/1982 | McPherson, Sr. | 84/291 |
| 5,125,312 | 6/1992 | Fishman et al. | 84/291 |
| 5,469,770 | 11/1995 | Taylor | 84/291 |

FOREIGN PATENT DOCUMENTS

| | | |
|---|---|---|
| 156228 | 1/1939 | Austria . |
| 527934 | 11/1921 | France . |
| 2841029 | 4/1980 | Germany . |
| 246649 | 6/1986 | Germany . |
| 5-333852 | 12/1993 | Japan . |

*Primary Examiner*—Robert E. Nappi
*Assistant Examiner*—Kim Lockett
*Attorney, Agent, or Firm*—Lyon & Lyon LLP

[57] ABSTRACT

The present invention involves a stringed musical instrument having a lower portion comprised of a resonance body and an upper portion comprised of a neck and headstock. The resonance body encloses a resonating chamber and has a sound board and a bridge for fastening multiple strings. One or more sound holes are carried by the resonance body. The neck has an upper end from which the headstock extends and a lower end that is secured to the resonance body. Multiple pegs located in the headstock are connected to the strings for tightening and loosening the strings. One or more sound holes are located in the upper portion of the instrument. An elongated, hollow, enclosed passage is located in the upper portion of the instrument and communicates the resonating chamber with the one or more sound holes in the upper portion.

9 Claims, 4 Drawing Sheets

STRINGED MUSICAL INSTRUMENT

FIELD OF THE INVENTION

The invention relates, in general, to a stringed musical instrument, and, in particular, to an acoustic guitar having sound improving features.

BACKGROUND OF THE INVENTION

Acoustic guitars include a sound hole located in a sound board at a centered position in a guitar body and underneath strings of the instrument. Vibration tones from the strings are transmitted to the sound board by a bridge. This causes vibration sound waves in the air filling the resonant cavity of the guitar body. The sound waves are resounded and amplified in the resonant cavity and are emitted from the guitar body through the sound hole. Although acoustic guitars have been designed this way for a long time, the sound emitted from these guitars is monophonic and often unclear.

SUMMARY OF THE INVENTION

The present invention overcomes these sound problems in acoustic guitars and other stringed musical instruments with a construction that improves the sound quality of the instrument. This is accomplished by a stringed musical instrument having a lower portion comprised of a resonance body and an upper portion comprised of a neck and headstock. The resonance body encloses a resonating chamber and has a sound board and a bridge for fastening multiple strings. One or more sound holes are carried by the resonance body. The neck has an upper end from which the headstock extends and a lower end that is secured to the resonance body. Multiple pegs located in the headstock are connected to the strings for tightening and loosening the strings. One or more sound holes are located in the upper portion of the instrument. An elongated, hollow, enclosed passage is located in the upper portion of the instrument and communicates the resonating chamber with the one or more sound holes in the upper portion.

When a string is filliped, the string begins to vibrate and thereby induces a sound wave which, in turn, is introduced into the resonance body through the sound board and causes a vibration wave in the air within the resonating chamber that is resounded and amplified therein. The sound wave may come out of the resonance body and/or travel through the elongated hollow passage to the one or more sound holes in the upper portion of the instrument where it may also exit the instrument. As a result, a stereophonic, genuinely clear and comfortable sound is produced by the instrument. The one or more sound holes in the upper portion of the instrument prevents the generation of a muttering secondary sound wave otherwise caused in the above resounding and amplifying operation by the advantageous co-action of the one or more sound holes in the resonance body and the one or more sound holes in the upper portion of the instrument.

Other, more particular features and advantages of the inventions are set forth in the following detailed description and drawings.

BRIEF DESCRIPTION OF THE DRAWINGS

The drawings illustrate both the design and utility of preferred embodiments of the present invention, in which similar elements are referred to by common reference numbers but with a different suffix, wherein.

DESCRIPTION OF THE PREFERRED EMBODIMENTS

Figure 1:
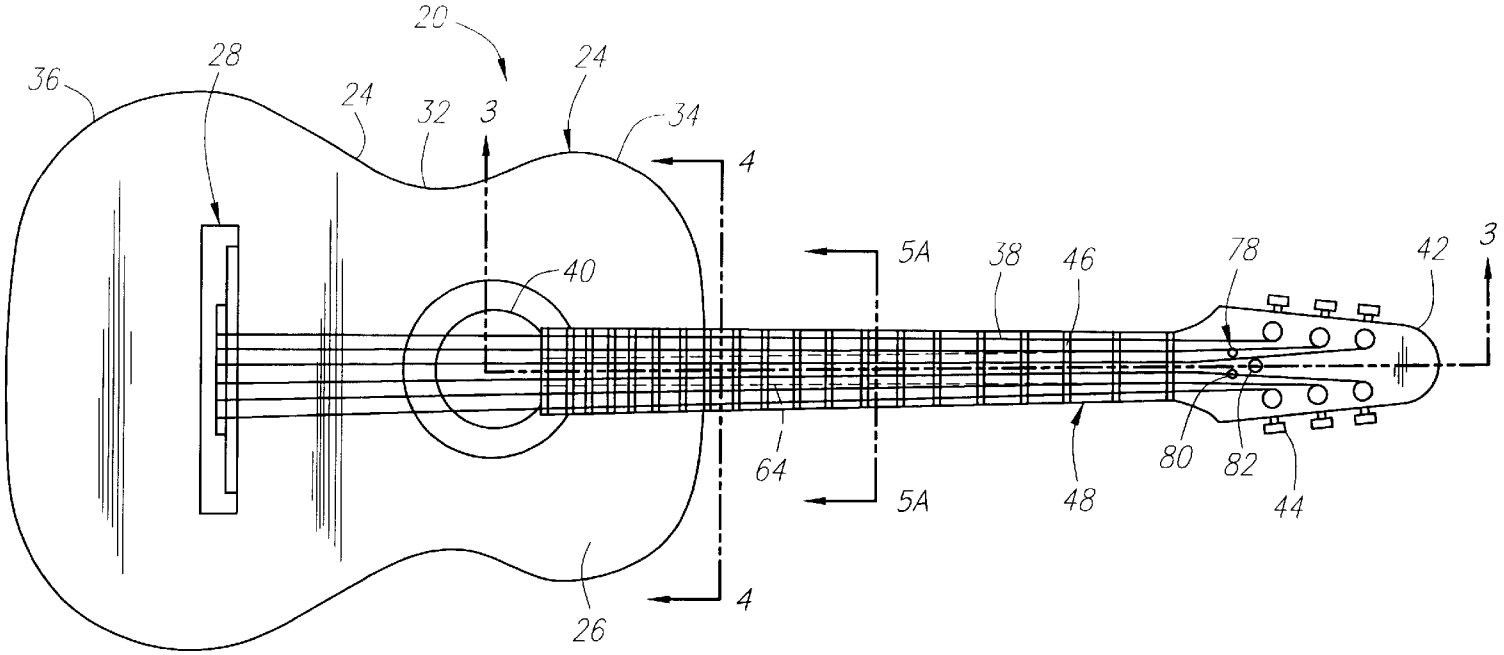
FIG. 1 is a top plan view of an acoustic guitar constructed in accordance with a preferred embodiment of the invention.
Figure 2:
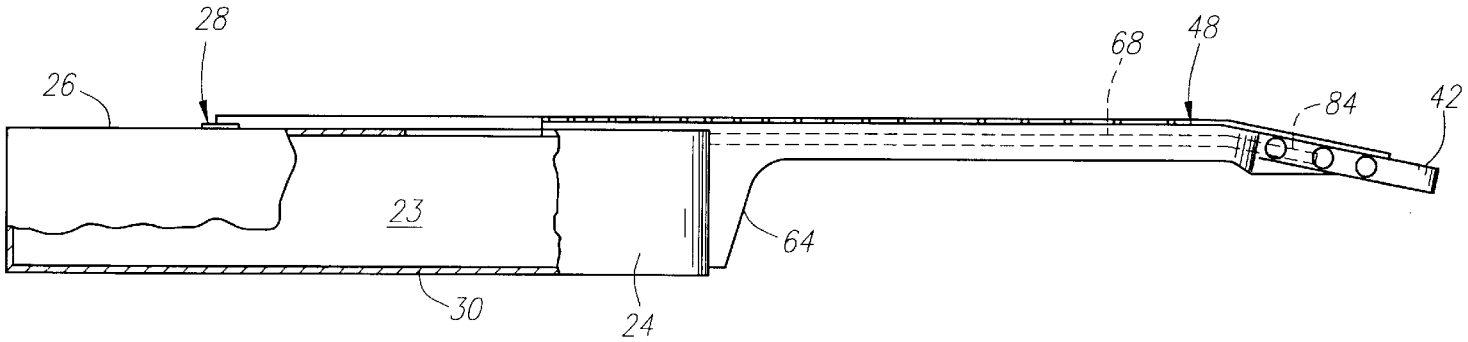
FIG. 2 is a side elevational view of the acoustic guitar with portions of the side wall removed to see the resonating chamber.

With reference to FIGS. 1 and 2, a preferred embodiment of an acoustic guitar, indicated generally by the reference numeral 20, will now be described. Other devices used to support its functions, add features, or provide alternative embodiments are also described below. Although the present invention is discussed in conjunction with an acoustic guitar, it will be readily apparent by those skilled in the art how the principles of the present invention may be applied to other stringed musical instruments having a hollow resonating cavity and at least one sound hole in the instrument body such as, but not by way of limitation, an electric acoustic, a jazz guitar, an electric guitar, a violin, a viola, a cello, a double bass, a cittern, a lute, a mandolin, a mandola, a mandocello, an ukulele, and a banjo. The guitar 20 is comprised of a lower portion and an upper portion. The lower portion includes a hollow guitar body or sound box 22 surrounding a resonating cavity 23. The guitar body 22 includes sides or ribs 24, a top or soundboard 26 on which a bridge 28 is mounted, and a back 30. The guitar body 22 has a waist 32 at the narrowest portion or midsection of the guitar 20. The portion of the guitar 20 above the waist 32 is known as the upper bout 34 and the portion of the guitar below the waist 32 is known as the lower bout 36. Guitar strings 38 stretch from the bridge 28, over a sound hole 40, and onto a headstock 42 and tuning keys 44. Upraised ridges called frets 46 are located at designated intervals on a neck 48 perpendicular to the strings 38. The upper portion of the guitar 20 includes the neck 48 and headstock 42.

With reference further to FIGS. 3–5A, the neck 48 is preferably constructed generally of an elongated lower neck member 50, an upper neck member 52, and a fret board 54. The neck 48 also includes an upper or distal neck portion in the general location of the headstock 42 and a lower or proximal neck portion in the general location of heel 68.

Although the neck 48 is described generally as including three members (50, 52, 54), it will be readily apparent to those skilled in the art that the neck 48 may have a construction consisting of a different number of members, i.e., one or more members. The fret board 54 carries the frets 46. The upper neck member 52 carries one or more elongated T-bar stiffeners 56 (a pair of stiffeners 56 in FIG. 5A) for improving the bending, torsional, and axial stiffness of the neck 48. Each stiffener 56 extends substantially the entire length of the neck 48. The stiffeners 56 are preferably made of aluminum; however, it will be readily apparent to those skilled in the art that other similar light-weight, stiff materials such as carbon-fiber neck rods may be used. The number and configuration of stiffeners may vary depending on the type of guitar.

The bottom surface of the upper neck member 52 and the top surface of the lower neck member 50 have a mating, step-shaped configuration to assist in creating a strong bond between these two members when an adhesive is applied so as to prevent lateral movement of the neck members 50, 52. The upper neck member 52 includes an elongated semicircular channel 58 and the lower neck member 50 includes a pair of elongated steps 60 joined laterally by an elongated incurved channel 62. When joined, the upper neck member 52 and lower neck member 50 form an elongated, enclosed passage 64 communicating the resonating cavity 23 of the sound box 22 with one or more sound holes 78 located in an upper or distal portion of the neck 48 of the headstock 42. Although the elongated passage 64 is shown as having a generally semicircular cross-section, it will be readily apparent to those skilled in the art that other cross-sectional shapes are desirable such as, but not by way of limitation, circular, elliptical, crescent-shaped, gibbous shaped, obround, or any similar rounded shape. The rounded cross-sectional shape of the elongated passage 64 provides good acoustical clarity in the guitar 20.

Figure 5B:
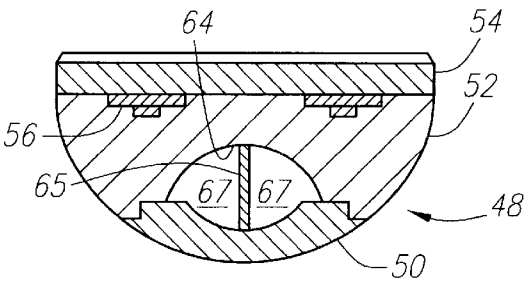
FIG. 5B is a cross-sectional view, similar to FIG. 5A, of an alternative embodiment of the neck of the guitar.
Figure 5A:
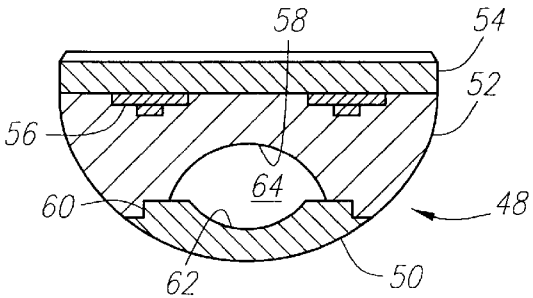
FIG. 5A is a cross-sectional view of the neck of the guitar in FIG. 1 taken along line 5A—5A.

With reference to FIG. 5B, an elongated center brace 65 may be vertically positioned within the passage 64 in order to keep the neck 48 from bending in response to the tension of the strings 38. The center brace 65 effectively divides the passage 64 into two passages 67. Accordingly, the neck 48 may include one or more elongated passages.

Figure 3:
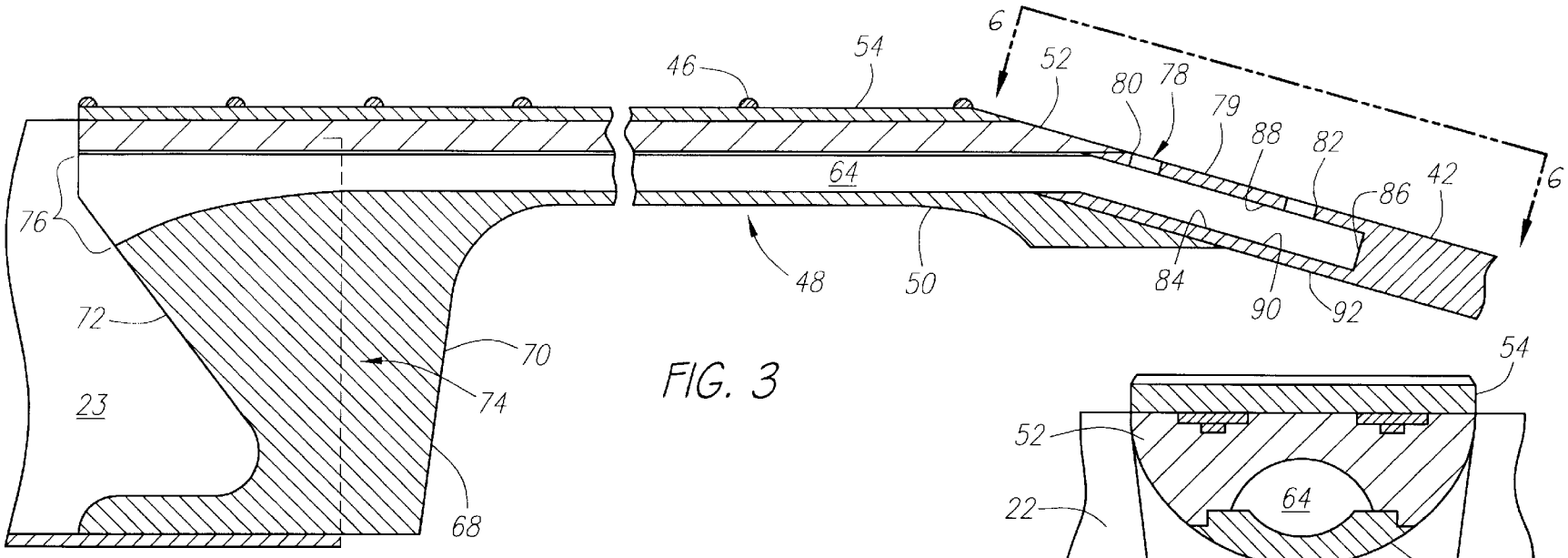
FIG. 3 is a partial cross-sectional view of the neck and sound box of the guitar in FIG. 1 taken along line 3—3.
Figure 4:
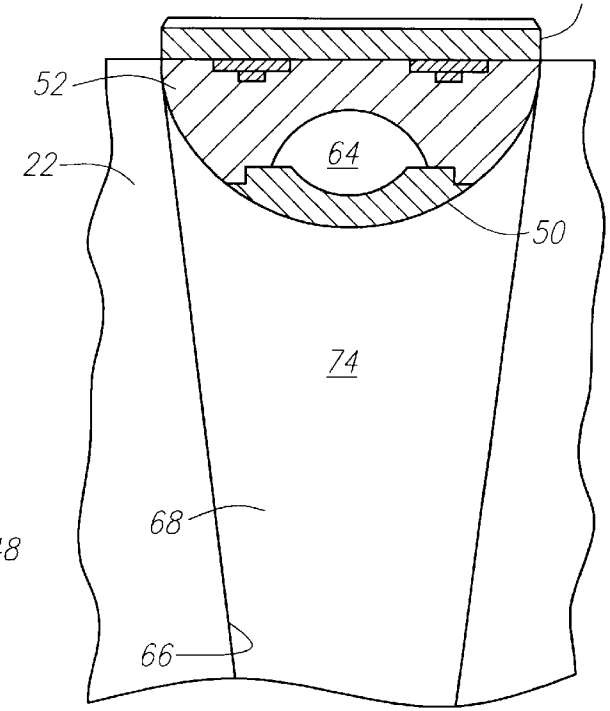
FIG. 4 is a cross-sectional view of the heel of the guitar in FIG. 1 taken along line 4—4.

With reference to FIGS. 3 and 4, the junction of the neck 48 and the guitar body 22 is shown. With reference specifically to FIG. 3, at the junction of the neck 48 and the guitar body 22, the guitar body 22 has a generally V-shaped groove 66. The fret board 54, upper neck member 52, and lower neck member 50 fit in a top part of the generally V-shaped groove 66 so that the top of the fret board 54 is generally flush with the top of the sound board 26. The neck 48 includes a heel 68 having an outer portion 70 and an inner portion 72 connected by an intermediate portion 74. The intermediate portion 74 is shaped to fit within a bottom part of the generally V-shaped groove 66. The outer portion 70 and inner portion 72 abut the outer side and the inner side of the guitar body 22, respectively.

With reference specifically to FIG. 3, a port 76 exists where the passage 64 communicates with the resonating cavity 23 of the guitar body 22. The cross-sectional area of the port opening 76 is larger than the cross-section area of the rest of the passage 64. The cross-sectional area of the passage 64 preferably tapers as shown in FIG. 3. A tapering passage 64 (as shown) helps to draw more sound waves into the passage 64 and channel them through to one or more sound holes 78 located in the headstock 42.

Figure 6:
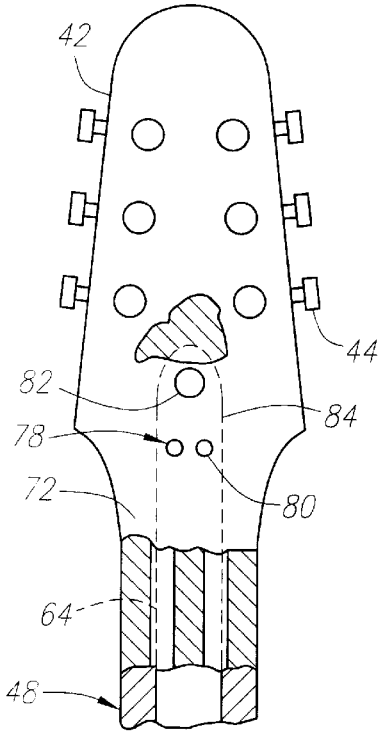
FIG. 6 is a top plan view of an upper portion of the neck of the guitar in FIG. 1, including the headstock, taken along lines 6—6 of FIG. 3.

With reference to FIGS. 1, 3 and 6, the sound holes 78 communicate with the passage 64 of the neck 48 for emitting sound waves from the resonating cavity 23. Thus, sound waves are emitted from the one or more sound holes 78 and the sound hole 40 of the guitar body 22, creating a stereophonic and clear sound. In a twelve-string guitar with a center brace 65 in the neck 48, preferably three holes 80, 82 are included the headstock 42. In most guitars that do not have a center brace 65, one hole is preferably included in the headstock 42. In the illustrated embodiment, the holes 80 located closer to the guitar body 22 are preferably smaller in diameter than the hole 82 located closer to the turning keys 44. Each sound hole 78 is preferably circular, but it will be readily apparent to those skilled in the art that a sound hole 78 may have a shape other than circular, and the shapes of the multiple sound holes may be the same or different if more than one sound hole 78 exists. Similarly, if multiple sound holes 78 exist, the sound holes 78 may have the same or different sizes. Altering the number, shapes, sizes, and locations of the sound holes 78 gives the guitar a different sound. The sound holes 78 are preferably located in a face 79 of the headstock 42, near an upper end of the neck 48. In an alternative embodiment, the one or more sound holes 78 are located in the neck 48, for example, in an upper portion of the neck 48.

The one or more sound holes 78 communicate with an elliptical well 84 in the headstock 42. The elliptical well 84 is bounded by a wall 86, a lower surface 88 of the headstock face 79, and an upper surface 90 of headstock back 92. The elliptical well 84 communicates with the passage 64 for transmitting sound waves between the sound holes 78 and the resonating cavity 23. Sound waves transmitted down the passage 64 towards the headstock 42 reflect off of the lower surface 88 of the headstock face 79 and, then, off of the upper surface 90 of the headstock back 92, and out of the sound holes 78. Soundwaves that do not make it out of the sound holes 78 are transmitted back through the elongated passage 64 to the resonating cavity 23, where they may exit the sound hole 40. The enclosed passage 64 in communication with the one or more sound holes 78 and resonating cavity 23 provides a natural reverb or echo. Sound waves travel from the resonating cavity 23 to the headstock 42 where some of the some of these sound waves are emitted through the one or more sound holes 78, and the sound waves not emitted from the holes 78 travel back to the resonating cavity 23. It is important for the elongated passage 64 to be enclosed in order to prevent sound waves from escaping through the neck 48 as they pass through the passage 64.

Figure 7:
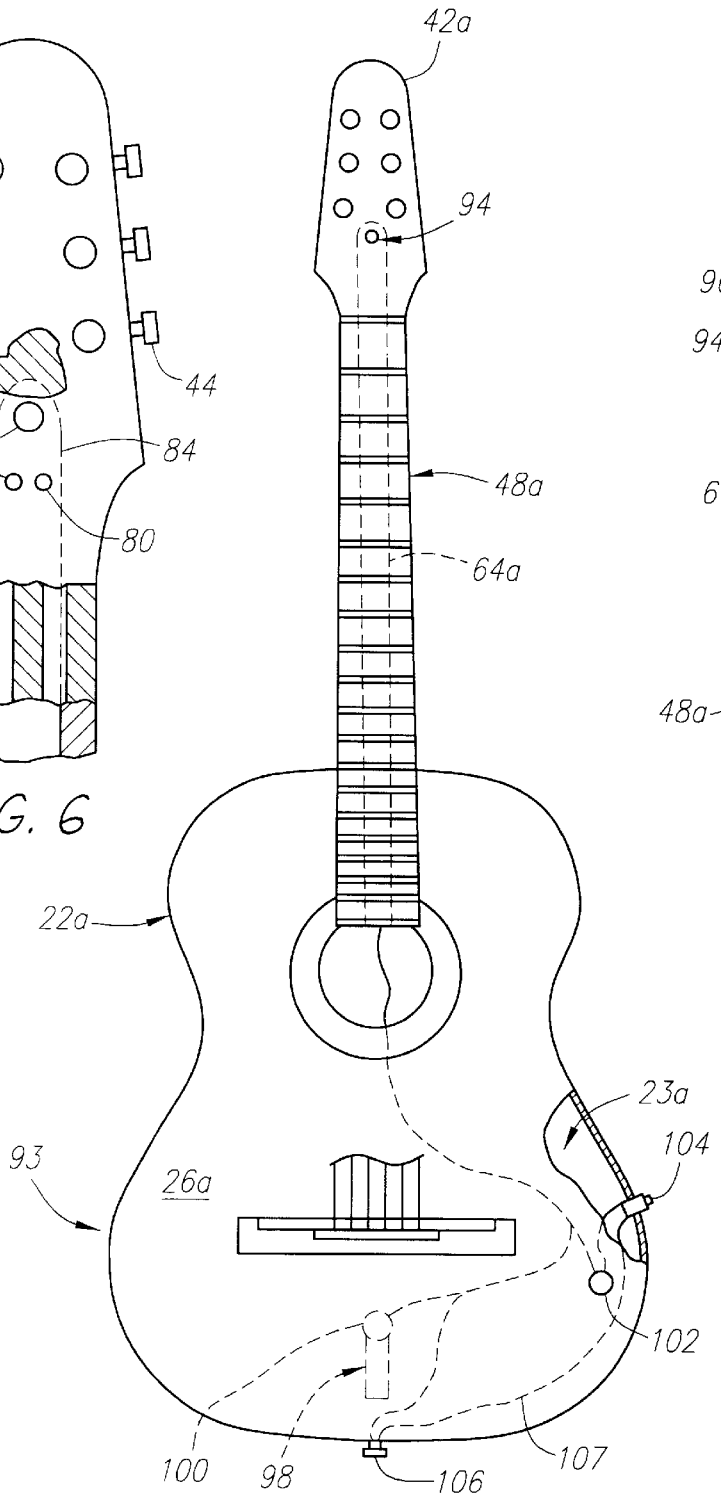
FIG. 7 is a top plan view of an electrical acoustic guitar constructed in accordance with an alternative embodiment of the invention and illustrates portions of the guitar fretboard and soundboard cut-away.
Figure 8:
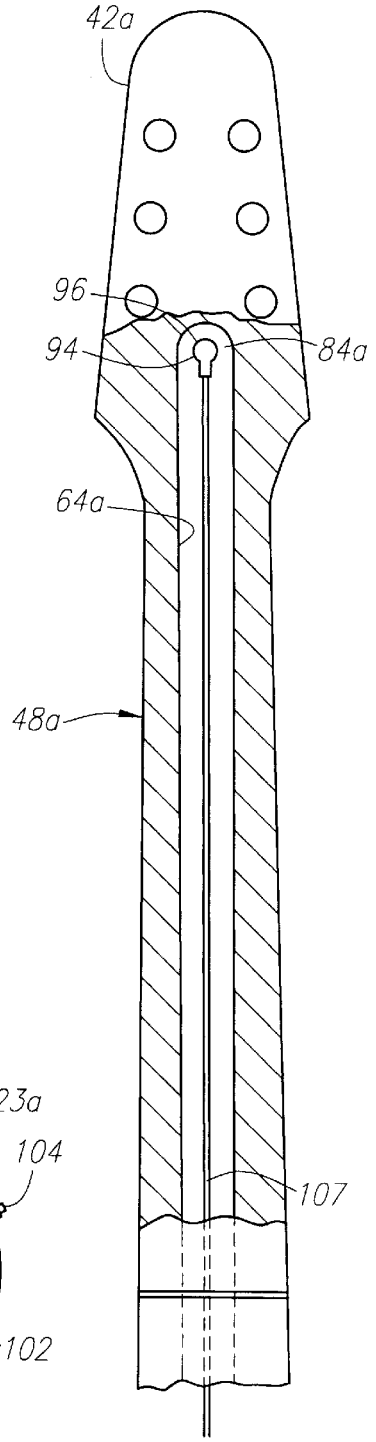
FIG. 8 is an enlarged top plan view of the neck of the guitar illustrated in FIG. 7.

With reference to FIGS. 7 and 8, an acoustic guitar 93 constructed in accordance with an alternative embodiment of the invention will now be described. Elements of the guitar 93 similar to those previously described are identified with the same reference numbers but with an "a" suffix. The acoustic guitar 93 is electrically amplified and includes a first electronic sound pick-up 94 having a first microphone 96 in the upper portion of the elongated passage 64*a*, preferably in the well 84*a* of the head stock 42*a*, and a second electronic sound pick-up 98 having a second microphone 100 in the resonating cavity 23*a* of the guitar body 22*a*. The precise location of the second microphone 100 is not of material consequence except that it preferably lies within a portion of the resonating cavity 23*a* somewhat removed from the origin of sounds and tones which will ultimately be picked up. The sound pick-ups 94, 98 are of substantially conventional construction such as is commonly available for this purpose, and are preferably provided with a conventional volume control 102 on the sound board 26*a* at a convenient location, a jack or instrument plug 104 of the usual sort and a switch 106 for turning on the first pick-up 94, the second pick-up 98, both pick-ups 94, 98, or turning the electronics off. Feed wires 107 connect the above-described components in a manner well known in the art.

Figure 9:
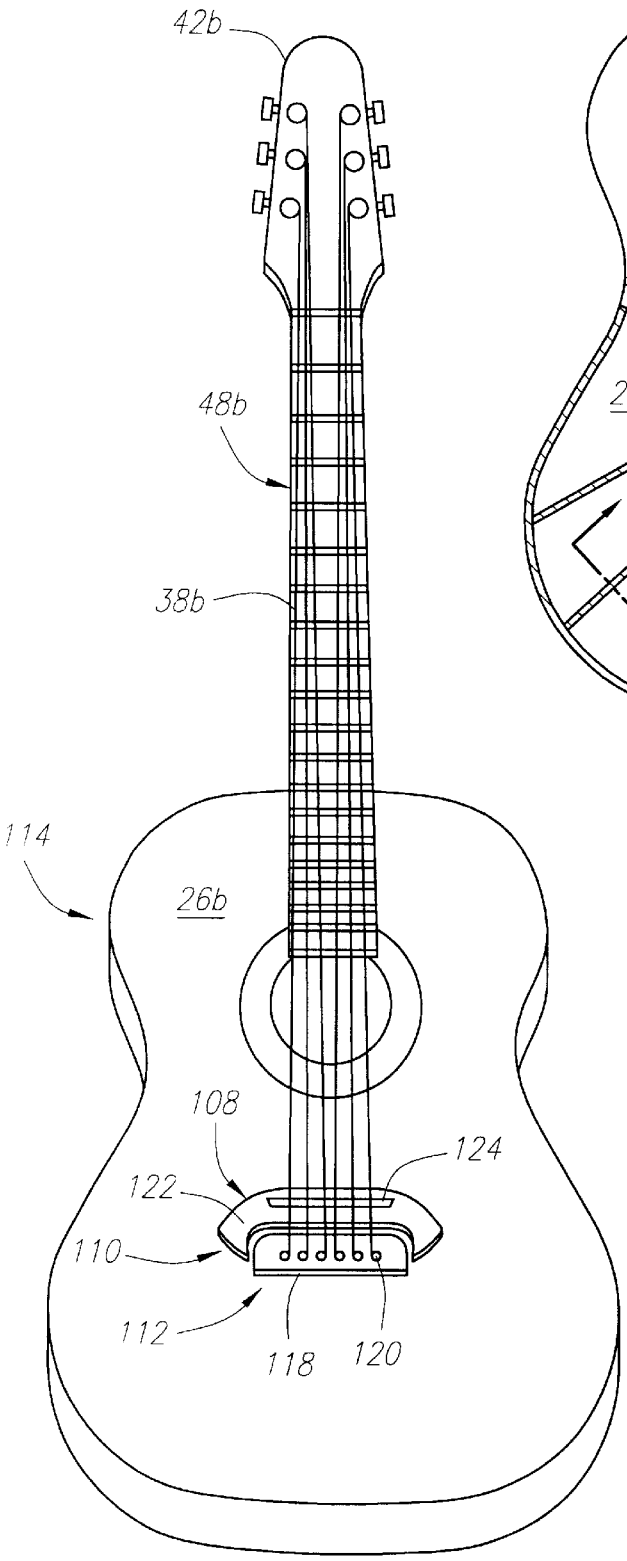
FIG. 9 is a top plan view of an acoustic guitar constructed in accordance with a further embodiment of the invention.

With reference to FIG. 9, an acoustic guitar 108 constructed in accordance with a further embodiment of the invention is shown. Elements of the guitar 108 similar to those previously described are identified with the same reference numbers but with a "b" suffix. The guitar 108 includes a two-part bridge 110 having a separate anchoring mechanism 112 and vibration transmitting mechanism 114. The anchoring mechanism 112 includes a first bridge 118. A plurality of pins 120 are disposed through respective holes in the first bridge 118 and soundboard 26*b*. The guitar strings 38*b* are connected to the pins 120 in a conventional manner. The vibration transmitting means 114 includes a second bridge 122. Multiple saddles 124 are carried by the second bridge 122. A bridge support (not shown) is used to support the two-part bridge 110 on the underside of the soundboard 26*b*. The above-described two-part bridge 110 allows vibrations to be free transmitted from the strings 38*b* to the soundboard 26*b* at the vibration transmitting means without being inhibited or restrained by the anchoring means 112.

Figure 10:
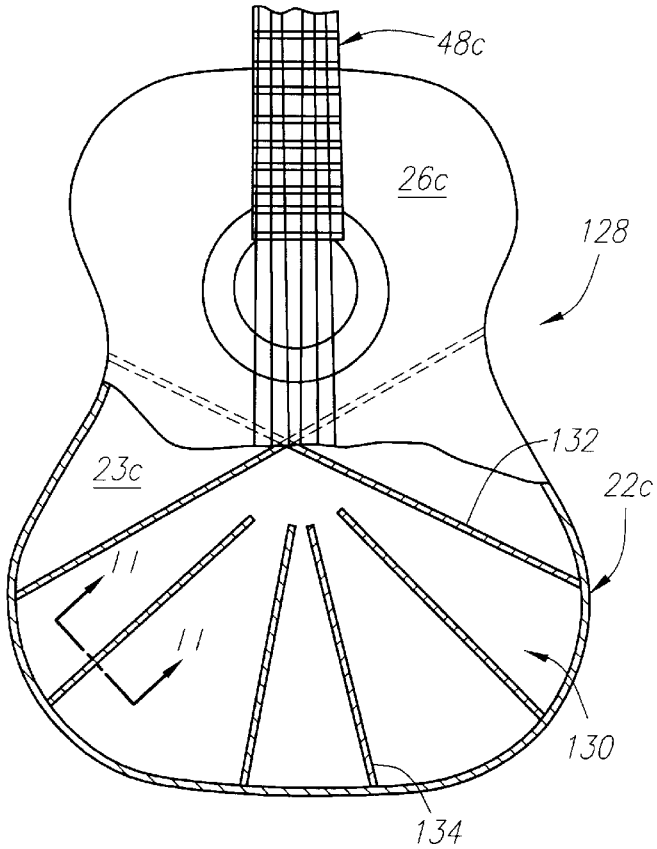
FIG. 10 is a top plan view of a guitar body constructed in accordance with a further embodiment of the invention with portions of the sound board cut-away.
Figure 11:
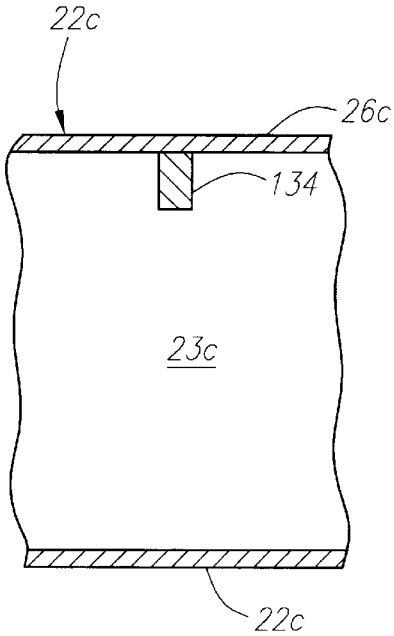
FIG. 11 is a cross-sectional view of the guitar body taken through lines 11—11 of FIG. 10.

With reference to FIGS. 10 and 11, an acoustic guitar 128 constructed in accordance with a still further embodiment of the invention will now be described. Elements of the guitar 128 similar to those previously described are identified with the same reference numbers but with a "c" suffix. The guitar 128 includes a bracing assembly 130 for the guitar body 22*c* having a generally "X-shaped" cross brace 132 and a series of radially extending braces 134. The radially extending braces 134 extend radially from the center of the sound box 22*c* along the bottom surface of the sound board 26*c* (FIG. 11). The radially extending braces 134 provides structure and support for the guitar body 22*c* and allows sound waves to freely travel within the resonating cavity 23*c*. Guitars in the past have included laterally extending braces. Laterally extending braces block the free travel of sound within the resonating cavity much like a dam blocks a river, causing dead spots in the guitar, especially near a bottom portion of the guitar body. The radially extending braces 134 allow the whole sound board 26*c* to act as a vibration transmitter without substantially blocking of transmitted sound within the resonating cavity 23*c*.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A stringed musical instrument, comprising:

a lower portion including a resonance body enclosing a resonating chamber, the resonance body having a sound board and a bridge for fastening multiple strings, at least one sound hole carried by said resonance body;

an upper portion including a neck and a headstock, the neck having an upper end from which said headstock extends and a lower end secured to said resonance body, multiple pegs located in said headstock and connected to said strings for tightening and loosening said strings, at least one sound hole located in the upper portion;

an elongated, hollow, enclosed passage provided in said upper portion and communicating said resonating chamber with said at least one sound hole of said upper portion; and an electronic pick-up located in the upper portion, the electronic pick-up having a microphone located in the elongated passage adjacent the at least one sound hole of said upper portion.

2. The stringed musical instrument of claim 1, further including an electronic pick-up in the lower portion having a microphone located in the resonant cavity of the resonance body.

3. The stringed musical instrument of claim 2, further including a three-way switch coupled to the electronic pick-up in the upper portion and the electronic pick-up in the lower portion, the switch configured to activate the electronic pick-up in the upper portion, the electronic pick-up in the lower portion, and both the electronic pick-up in the upper portion and the electronic pick-up in the lower portion.

4. A stringed musical instrument, comprising:

a lower portion including a resonance body enclosing a resonating chamber, the resonance body having a sound board provided with a sound hole and a bridge for fastening multiple strings;

an upper portion including a neck and a headstock, the neck having a lower end and an upper end, the neck secured to said resonance body at the lower end of the neck, said headstock having multiple pegs connected to said strings for tightening and loosening said strings at the upper end of the neck, means for emitting sound from the upper portion;

means for transmitting sound vibrations from the resonating chamber to the sound emitting means; and an electronic pick-up located in the upper portion having a microphone located in the transmitting means.

5. The stringed musical instrument of claim 4, further including an electronic pick-up in the lower portion having a microphone located in the resonant cavity of the resonance body.

6. The stringed musical instrument of claim 5, further including a three-way switch coupled to the electronic pick-up in the upper portion and the electronic pick-up in the lower portion, the switch configured to activate the electronic pick-up in the upper portion, the electronic pick-up in the lower portion, and both the electronic pick-up in the upper portion and the electronic pick-up in the lower portion.

7. A stringed musical instrument, comprising:

a resonance body enclosing a resonating chamber, the resonance body having a sound board provided with a sound hole and a bridge for fastening multiple strings;

a neck including an upper end and a lower end, the neck secured to said resonance body at said lower end and including a headstock having multiple pegs connected to said strings for straining and loosening said strings at said upper end, at least one sound hole located in said headstock;

an elongated, enclosed passage located in said neck, said passage including a well located in the headstock, the passage in communication with said at least one sound hole in the headstock and the resonating chamber, the elongated passage having a tapered configuration; and an electronic pick-up located in the upper portion having a microphone located in the elongated passage adjacent to said at least one sound hole.

8. The stringed musical instrument of claim 7, further including an electronic pick-up located in the lower portion having a microphone located in the resonant cavity of the resonance body.

9. The stringed musical instrument of claim 7, further including a three-way switch coupled to the electronic pick-up in the elongated passage and the electronic pick-up in the resonance body, the switch configured to activate the electronic pick-up in the elongated passage, the electronic pick-up in the resonance body, and both electronic pick-up in the elongated passage and the electronic pick-up in the resonance body.

* * * * *